US012478824B2

(12) United States Patent
Hsu

(10) Patent No.: US 12,478,824 B2
(45) Date of Patent: Nov. 25, 2025

(54) BENCH SEAT TRAINING STRUCTURE WITH ADJUSTABLE RESISTANCE

(71) Applicant: Chih-Yung Hsu, Tainan (TW)

(72) Inventor: Chih-Yung Hsu, Tainan (TW)

( * ) Notice: Subject to any disclaimer, the term of this patent is extended or adjusted under 35 U.S.C. 154(b) by 360 days.

(21) Appl. No.: 18/187,192

(22) Filed: Mar. 21, 2023

(65) Prior Publication Data

US 2024/0181291 A1 Jun. 6, 2024

(30) Foreign Application Priority Data

Dec. 6, 2022 (TW) ..... 111213435

(51) Int. Cl.
*A63B 21/00* (2006.01)

(52) U.S. Cl.
CPC ..... *A63B 21/4029* (2015.10); *A63B 21/154* (2013.01); *A63B 21/4035* (2015.10)

(58) Field of Classification Search
CPC ..... A63B 21/4029; A63B 21/154; A63B 21/4035; A63B 21/0555; A63B 21/4011; A63B 21/0552
See application file for complete search history.

(56) References Cited

U.S. PATENT DOCUMENTS 4,911,436 A * 3/1990 Lighter ..... A63B 21/4047 482/138
5,354,251 A * 10/1994 Sleamaker ..... A63B 21/4047 482/142
10,933,279 B1 * 3/2021 Sallie ..... A63B 23/0211
11,745,040 B1 * 9/2023 Krull ..... A63B 21/4029 482/118
2002/0077229 A1 * 6/2002 McBride ..... A63B 23/035 482/130
2003/0032524 A1 * 2/2003 Lamar ..... A63B 21/4029 482/8
2003/0211920 A1 * 11/2003 Mandel ..... A63B 21/015 482/115
2004/0002412 A1 * 1/2004 Kuo ..... A63B 21/055 482/129
2004/0135416 A1 * 7/2004 Parker ..... A47C 9/002 297/377

(Continued)

FOREIGN PATENT DOCUMENTS

TW I433700 4/2014
TW M624483 3/2022

*Primary Examiner* — Andrew S Lo
(74) *Attorney, Agent, or Firm* — MUNCY, GEISSLER, OLDS & LOWE, P.C.

(57) ABSTRACT

A bench seat training structure with adjustable resistance includes: a base frame extending in a horizontal direction and including first and second support portions on opposite ends thereof in the horizontal direction as well as a bench portion, the first and second support portions and the bench portion jointly defining a bottom space; a transmission unit disposed on the base frame and including a pull cord having a free end and a fixed end; and an adjustable resistance unit disposed in the bottom space, with the fixed end being directly or indirectly connected thereto so that when an operational force is applied to the free end, the pull cord is dragged to move and a resistance is applied to the fixed end. Therefore, an operator can apply a force onto either side of the base frame to select various training modes and to adjust the resistance at will.

21 Claims, 18 Drawing Sheets

(56) References Cited

U.S. PATENT DOCUMENTS

| | | | | |
|---|---|---|---|---|
| 2007/0155604 | A1* | 7/2007 | Hockemeyer | A63B 21/078 482/142 |
| 2007/0270292 | A1* | 11/2007 | Laney | A63B 22/0605 482/121 |
| 2011/0065554 | A1* | 3/2011 | Van Straaten | A63B 21/4029 482/130 |
| 2012/0100965 | A1* | 4/2012 | Dreissigacker | A63B 22/0005 482/72 |
| 2016/0089558 | A1* | 3/2016 | Noyes | A63B 21/4029 482/130 |
| 2017/0100622 | A1* | 4/2017 | Wall | A63B 21/4029 |
| 2019/0151699 | A1* | 5/2019 | Isom | A63B 21/00061 |
| 2019/0344123 | A1* | 11/2019 | Rubin | A63B 21/0058 |
| 2020/0030660 | A1* | 1/2020 | Herring | A63B 21/4039 |
| 2020/0306575 | A1* | 10/2020 | Knox | A63B 21/154 |
| 2022/0072365 | A1* | 3/2022 | Negrete | A61H 1/0292 |
| 2022/0233910 | A1* | 7/2022 | Leavitt | A63B 71/0036 |
| 2023/0173331 | A1* | 6/2023 | Wilson | A63B 21/4034 482/138 |
| 2023/0372762 | A1* | 11/2023 | Mitchell | A63B 21/154 |
| 2023/0381573 | A1* | 11/2023 | Hsu | A63B 23/0211 |
| 2024/0082625 | A1* | 3/2024 | Hsu | A63B 21/0442 |

* cited by examiner

BENCH SEAT TRAINING STRUCTURE WITH ADJUSTABLE RESISTANCE

BACKGROUND OF THE INVENTION

(a) Field of the Invention

The present invention relates to an exercising device which can be used selectively in various kinds of training modes by changing a relative position between a movable seat and a guiding piece.

(b) Description of the Prior Art

There are many kinds of exercising apparatuses on the market, and each one has its various training modes for users' choice.

A Taiwanese invention patent 1433700, "Stretching Equipment," published on Apr. 11, 2014, discloses a patent including a bed, a supporting device, a stretching device and a shifting apparatus. The supporting device is used for supporting the bed. The stretching device has a footboard and a linking-up portion. The shifting apparatus has a movable element and a regulation element. The movable element is disposed on the linking-up portion. The regulation element can make the movable element shifted between a first position and a second position, and then located at any point. The movable element can have the linking-up portion shifted, and the linking-up portion can have the footboard shifted between a third position and a fourth position, and then located at any point. Therefore, a user can lie on the bed and adjust his or her foot's setting angle directly, without moving his or her body at all.

This prior art is only provided with a single training mode for extending or stretching legs and cannot be used to train other parts of the body. Therefore, if one needs to carry out the training in various training modes, he or she will have to purchase other corresponding exercising apparatuses, which causes waste and takes up too much space to emplace the apparatuses.

A Taiwanese utility model patent M624483, "Multifunctional Rowing Machine," published on Mar. 11, 2022, discloses a machine including a rack unit, a resistance unit, and a drive unit. The rack unit includes a main rack, a first bracket connected to the main rack, at least one second bracket connected to the first bracket, and an auxiliary bracket connected to the main rack. The rack unit can change between a horizontal state and an upright state. In the horizontal state, a main connecting rod is placed horizontally, and the first bracket and the auxiliary bracket are supported on ground. In the upright state, the main connecting rod is vertically placed, and the second bracket and the first bracket are supported on the ground. The resistance unit is disposed on the rack unit and is used to provide resistance. The drive unit is disposed on the rack unit and is connected to the resistance unit. By the rack unit, the effect of having a variety of exercising types to enhance the effect of muscle training and save space can be achieved.

The rack unit of the prior art can change between the horizontal state and the upright state to achieve the training modes for various kinds of exercises. However, in changing between the horizontal state and the upright state, the structure of the rack unit needs to be changed to be placed horizontally or vertically, which is rather troublesome in implementation. In addition, it wastes a lot of time in dismantling and assembling the rack unit; therefore, it is not very perfect in using the rowing machine.

SUMMARY OF THE INVENTION

Accordingly, in terms of the abovementioned shortcomings in the existing recumbent exercising devices, the present invention provides a bench seat training structure with adjustable resistance, comprising a base frame which is extended in a horizontal direction and includes a first support portion and a second support portion on one end in the horizontal direction, with the base frame being provided with a bench portion horizontally, the length of the bench portion being extended in the horizontal direction, and the first support portion, the second support portion and the bench portion jointly defining a bottom space; at least a transmission unit which is disposed on the base frame and each transmission unit includes a pull cord, with the pull cord including a free end and a fixed end; and an adjustable resistance unit which is disposed on the base frame and is placed in the bottom space, with the adjustable resistance unit being equipped with the adjustable resistance. The fixed end is directly or indirectly connected to the adjustable resistance unit, an operational force is applied onto the free end, the resistance is applied onto the fixed end, and the operational force drags the pull cord to move on a moving path.

Preferably, the present invention further includes at least a retracting unit. The number of retracting unit corresponds to the number of transmission unit. The at least one retracting unit is disposed on the base frame and is connected to the at least one transmission unit respectively and also connected to the adjustable resistance unit. The retracting unit provides a restoring force to the corresponding transmission unit, and the restoring force is opposite to the operational force.

Preferably, each transmission unit includes a pulley set. The pulley set includes a moving pulley and at least one fixed pulley. The pull cord wraps around the moving pulley and the fixed pulley. Each retracting unit includes a spindle, a transmission wheel, a one-way wheel, a retractor, a connecting piece, and an auxiliary pulley. The spindle is pivoted on the base frame, the transmission wheel is fixed on the spindle, and a one-way bearing is disposed between the one-way wheel and the spindle. The retractor is connected to the spindle, and the retractor includes a casing and a volute spring. An end of the volute spring is fixed on an inner wall of the casing, and the other end of the volute spring is fixed on the spindle. The connecting piece is connected to the one-way wheel and the moving pulley.

Preferably, the present invention further includes at least a guiding piece and at least a movable seat, wherein the movable seat is disposed corresponding to the guiding piece. The guiding piece is disposed in the bottom space, the movable seat moves relatively on or is fixed on the guiding piece, selectively. The fixed end is fixed on the corresponding movable seat, and each movable seat includes a slide-assistance portion. The pull cord passes through the slide-assistance portion, and the free end is exposed out of the slide-assistance portion. By changing a relative position between the movable seat and the guiding piece, the position of the slide-assistance portion on the base frame is changed.

Preferably, each movable seat includes a movable seat roller, the pull cord wraps around the movable seat roller and then passes through the slide-assistance portion. The slide-assistance portion is a perforation or a slide-assistance roller. The slide-assistance roller is pivoted on a slide-assistance roller seat, and the slide-assistance roller seat can be rotatably fixed on the movable seat.

Preferably, the guiding piece is extended in the horizontal direction, and each guiding piece includes a positioning rod and a slide rail. The movable seat is provided with a positioning seat corresponding to the positioning rod, the positioning seat is provided with a positioning member, and the positioning member is selectively positioned on the positioning rod. The movable seat is provided with a slide seat corresponding to the slide rail, and the slide seat is disposed on the slide rail. When the positioning member is no longer positioned on the positioning rod, the movable seat slides on the guiding piece by the slide seat. The positioning rod is provided with plural positioning holes in an axial direction, the positioning member is a positioning pin, and the positioning pin corresponds in configuration to the positioning holes to be inserted into or escaped from any one of the positioning holes.

Preferably, the bench portion includes a first pad and a second pad. The first pad is provided with a first surface, the second pad is provided with a second surface, and a changeable included angle is disposed between the first surface and the second surface, between 0° and 180°.

Preferably, the base frame is provided with a first side and an opposite second side in the horizontal direction. The first side is provided with a bracket, the bracket is provided with at least one first side roller, and the free end selectively passes through the first side roller and is fixed on a handle, allowing the pull cord to move on the first side roller.

Preferably, the second side is provided with at least one second side roller, and the free end selectively passes through the second side roller and is fixed on a handle, allowing the pull cord to move on the second side roller.

Preferably, the present invention further includes a pull rod. The pull rod is provided with a pull rod combination portion, and the free end is selectively fixed on the pull rod combination portion.

Preferably, the present invention further includes at least one wearing piece. The wearing piece is provided with a wearing piece combination portion, and the free end is selectively fixed on the wearing piece combination portion.

Preferably, the adjustable resistance unit is a magnetic resistor, a friction force resistor, an air resistor, a liquid resistor, a motor or an electromagnetic braking resistor.

Preferably, the first support portion or the second support portion can be bent on the base frame relatively.

The present invention is preferably provided with following advantages:

1. The bench seat is combined with the adjustable resistance unit. When different trainings are executed using the bench seat, the strength of training can be adjusted freely through the adjustable resistance unit, so that the bench seat can be equipped with more training purposes, thereby increasing the practicality of the bench seat.
2. When using the bench seat to execute muscle training to different part of body, the required resistance is not necessarily the same. For example, the required resistance in a training for lifting legs is smaller than the resistance in using two arms to simulate lifting dumbbells. By adjusting the resistance with the adjustable resistance unit, it can avoid causing sports injury from all kinds of training using the bench seat.
3. The pull cord can be dragged by various positions of the bench seat. For example, when a user drags the pull cord vertically with a single hand while he or she is seated, the bench seat can simulate lifting a dumbbell. By adjusting the resistance with the adjustable resistance unit, the dumbbell in different weight can be simulated. In addition, a different adjustable resistance unit can be used individually in a training mode of rowing a boat. Furthermore, when the user drags the pull cord in a recumbent position, the bench seat can simulate lifting a dumbbell. By adjusting the resistance with the adjustable resistance unit, the dumbbell in different weight can be simulated. For other trainings, such as stretching a chest, lifting legs, etc., the strength of training can all be changed by adjusting the resistance with the adjustable resistance unit.
4. The first support portion or the second support portion can be bent on the base frame relatively. Therefore, when the bench seat is placed obliquely, the adjustable resistance unit and the pull cord can be still used for training. For example, an operator lies down on the bench seat in an oblique direction, with his or her head in a downward direction, and then drags the pull cord with this posture. In comparison with lifting a dumbbell while the operator lies down flat, the force applied by this simulation of lifting the dumbbell when the operator lies down in the oblique direction can be used to train muscles in arms and a chest.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 12:
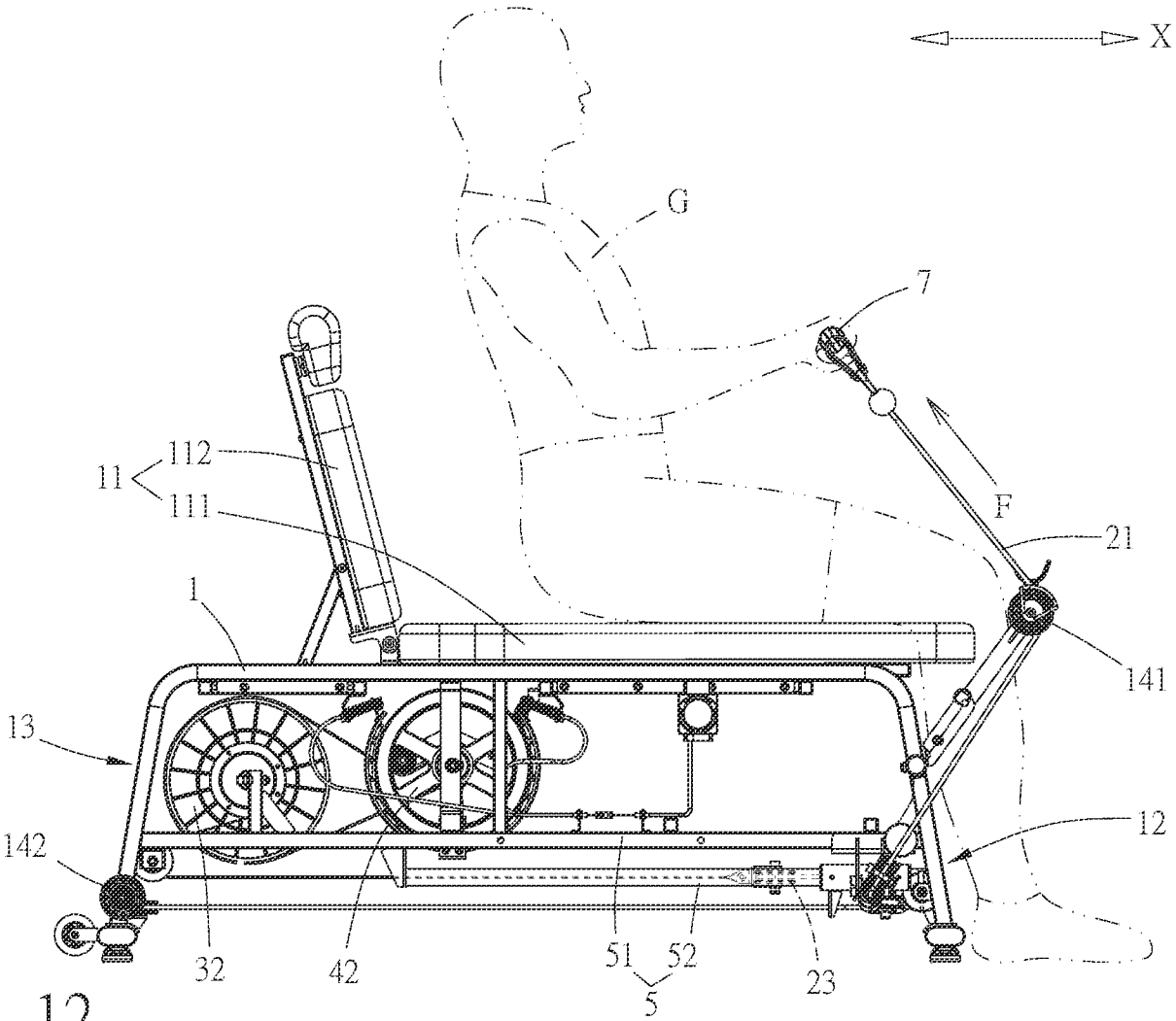
FIG. 12 shows a schematic view of the present embodiment used in a rowing mode for training.
Figure 13:
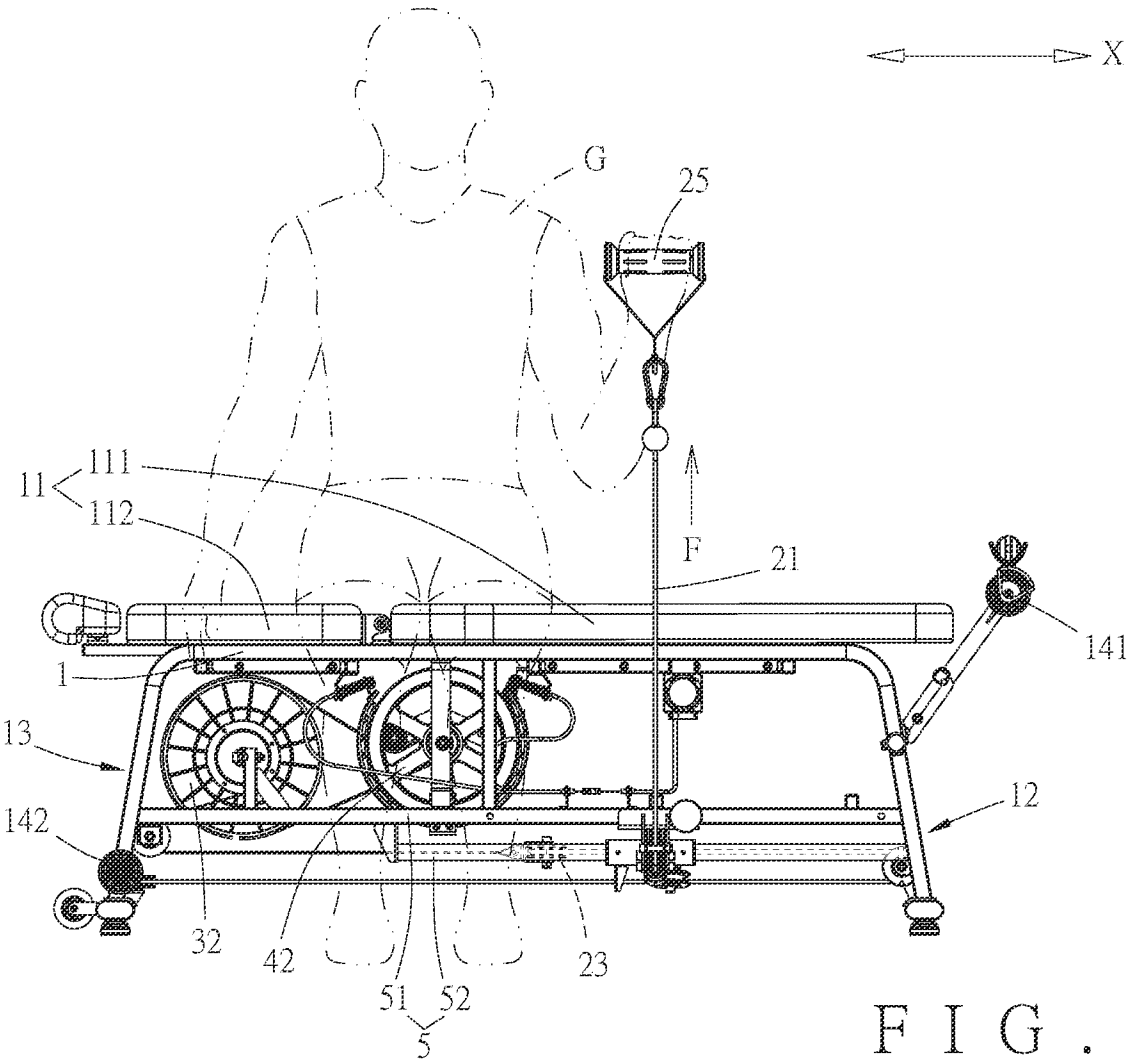
FIG. 13 shows a schematic view of the present embodiment used as dumbbells for training.
Figure 14:
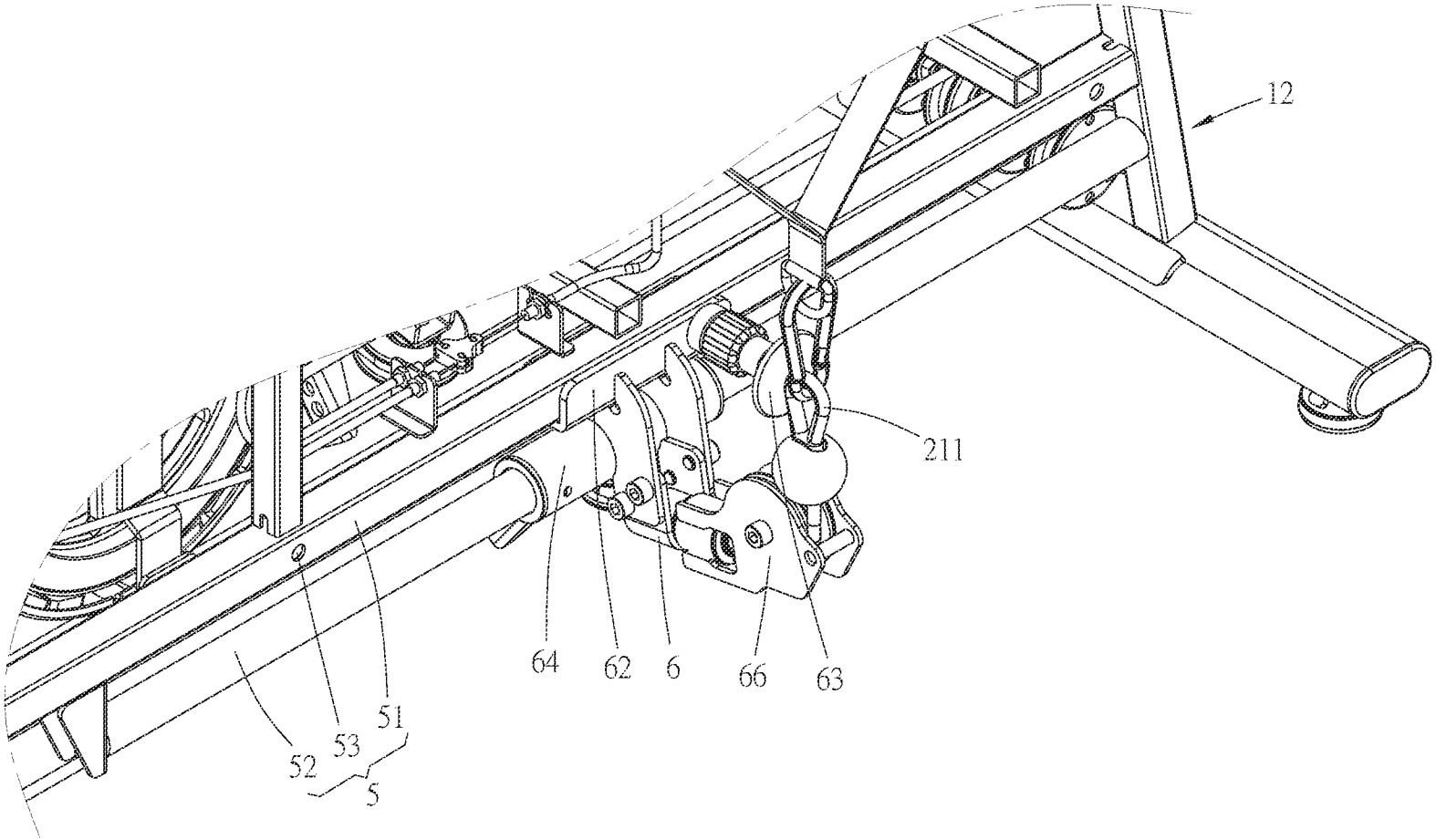
FIG. 14 shows a schematic view of the movable seat changing a position relative to the guiding piece, according to the present embodiment.

In the following embodiment, the terms of direction, such as left, right, front, rear, up and down, are all the relative orientations that an operator G (as shown in FIG. 12) feels when he or she sits down on a first pad 111 of a base frame 1 of the present invention, with an upper body in an upright posture and two eyes looking forward in a horizontal direction X. These terms of direction are only used as a convenient way to describe the present embodiment and are not meant to limit the spatial configurations of the present invention.

Figure 1:
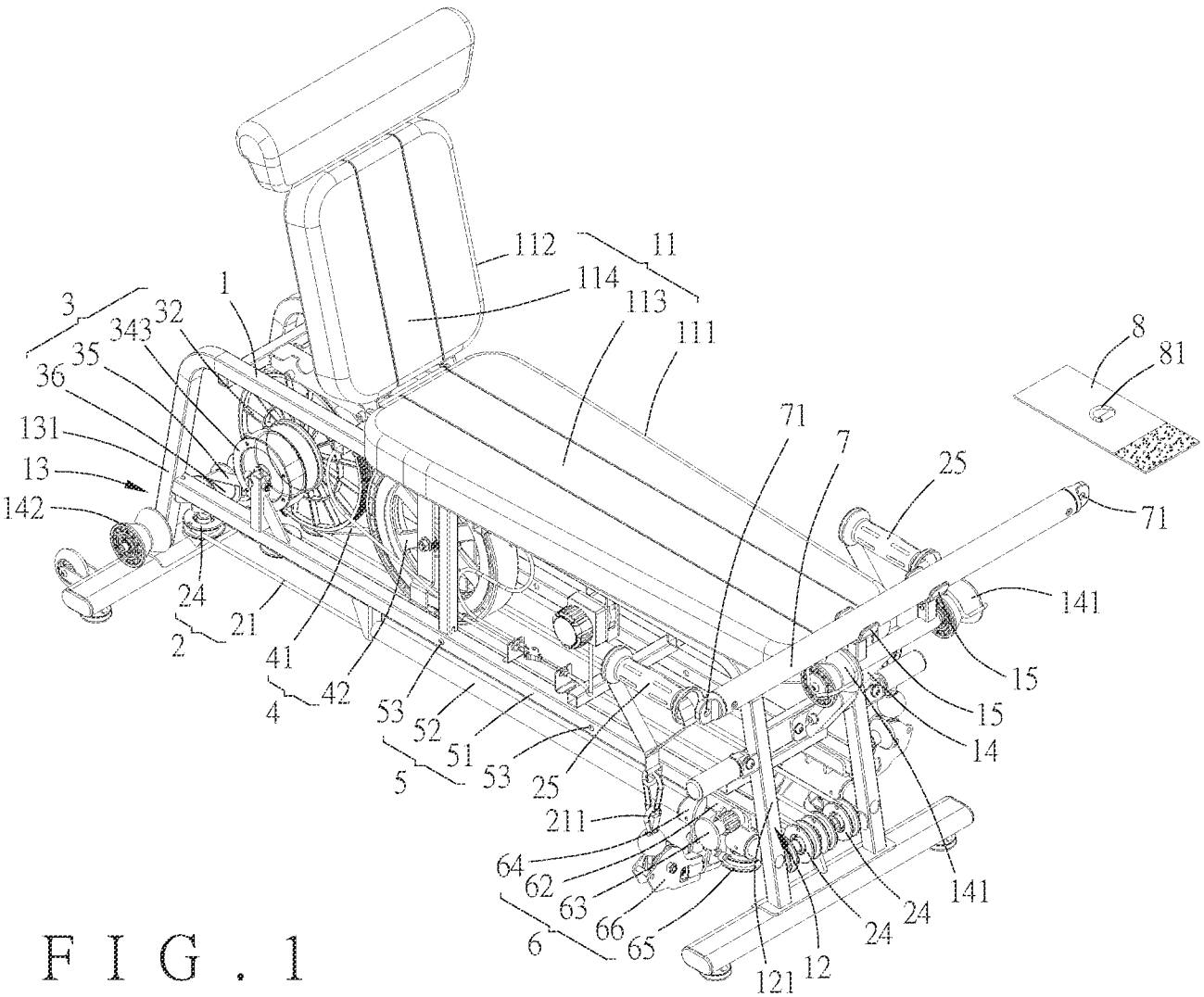
FIG. 1 shows a perspective view of the present embodiment.
Figure 2:
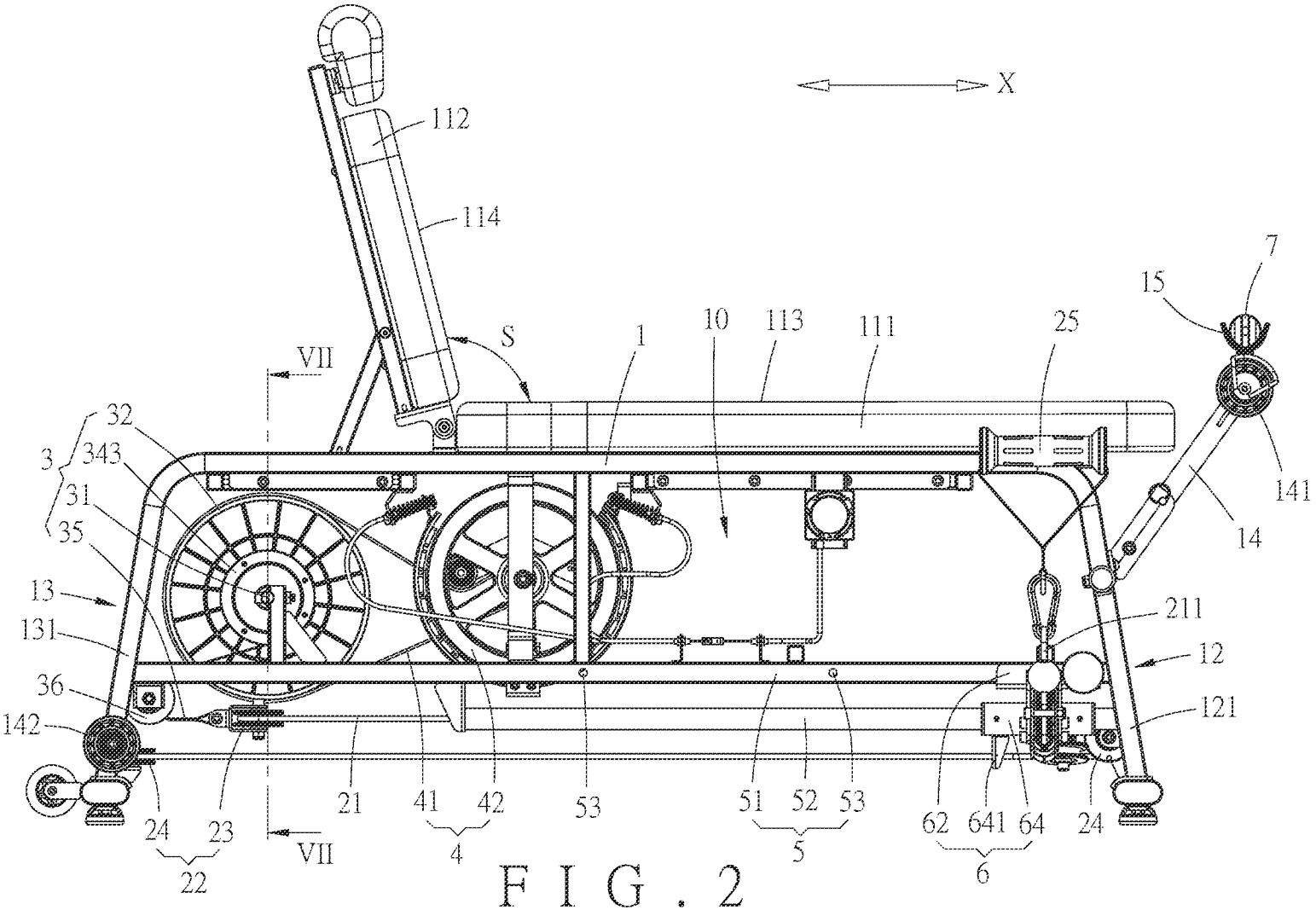
FIG. 2 shows a front view of the present embodiment.
Figure 3:
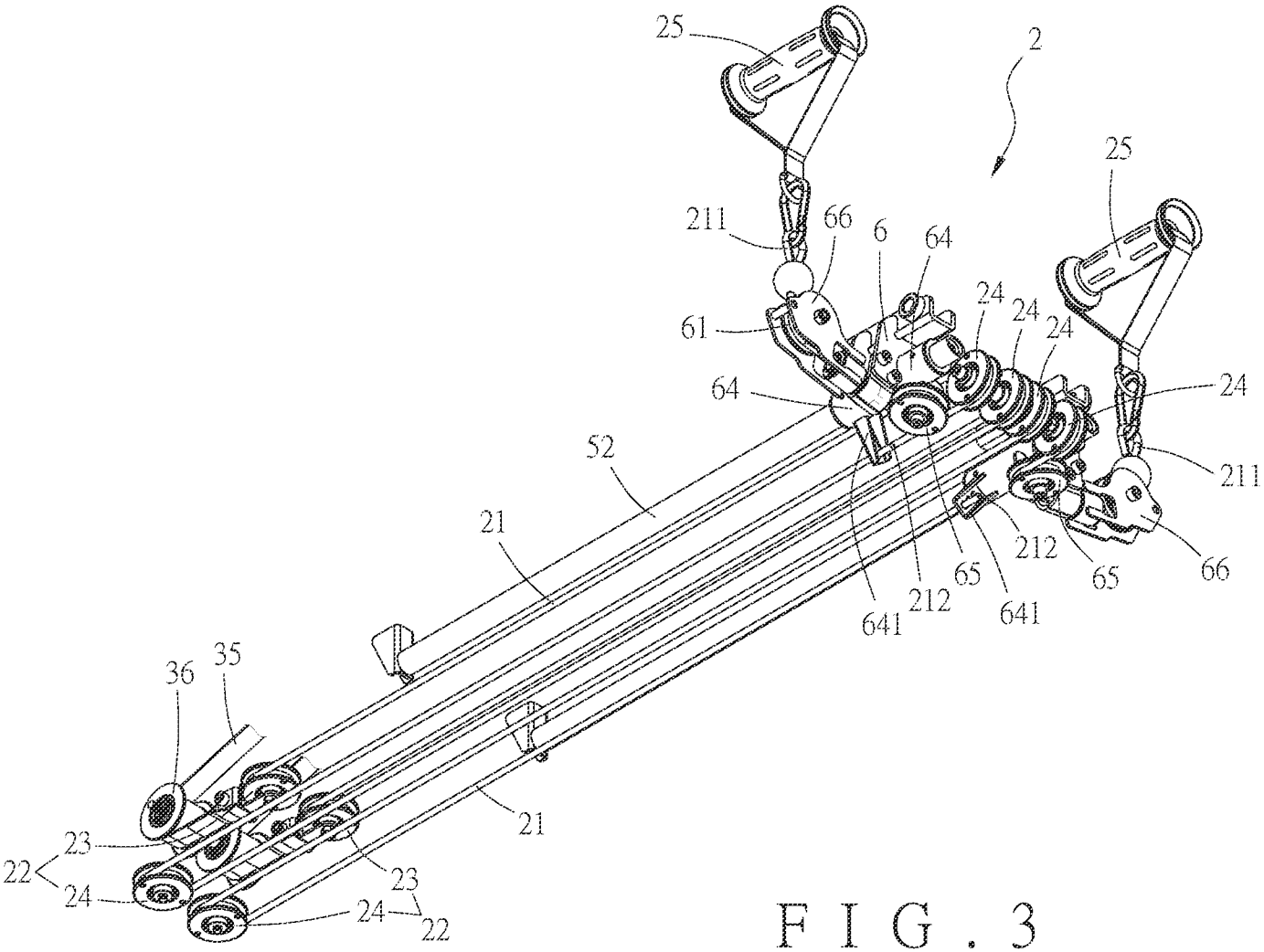
FIG. 3 shows a perspective view of part of components, according to the present embodiment.

Referring to FIG. 1, FIG. 2, and FIG. 3, the present embodiment comprises a base frame 1, a transmission unit 2, a retracting unit 3, an adjustable resistance unit 4, a guiding piece 5, a movable seat 6, a pull rod 7 and a wearing piece 8. In the present embodiment, there are two sets of the transmission unit 2, the retracting unit 3, the guiding piece 5, and the movable seat 6, which are symmetrically disposed on a left and right side to the horizontal direction X. However, if there is one set of the transmission unit 2, the retracting unit 3, the guiding piece 5, and the movable seat 6, and they are all disposed on the left or right side to the horizontal direction X allowing a user to operate from a single side, then it is also a feasible embodiment of the present invention. The following embodiment is described with a configuration of providing two sets of the transmission unit 2, the retracting unit 3, the guiding piece 5, and the movable seat 6.

The base frame 1 is extended in a horizontal direction X and includes a bench portion 11. The bench portion 11 is extended in the horizontal direction X and includes a first pad 111 and a second pad 112. The first pad 111 and the second pad 112 are raised and positioned in multiple stages. The first pad 111 is provided with a first surface 113, and the second pad 112 is provided with a second surface 114. By raising the first pad 111 and the second pad 112, a changeable included angle S can be disposed between the first surface 113 and the second surface 114, and the included angle S is between 0° and 180°. The base frame 1 is provided with a first side 12 and an opposite second side 13 in the horizontal direction X, the first side 12 is provided with a first support portion 121, and the second side 13 is provided with a second support portion 131. The first support portion 121, the second support portion 131, and the bench portion 11 jointly define a bottom space 10. The first side 12 is also provided with a bracket 14, the bracket 14 is provided with at least one first side roller 141; whereas, the second side 13 of the base frame 1 is provided with at least one second side roller 142, and a top of the bracket 14 is provided with an accommodation portion 15.

Figure 4:
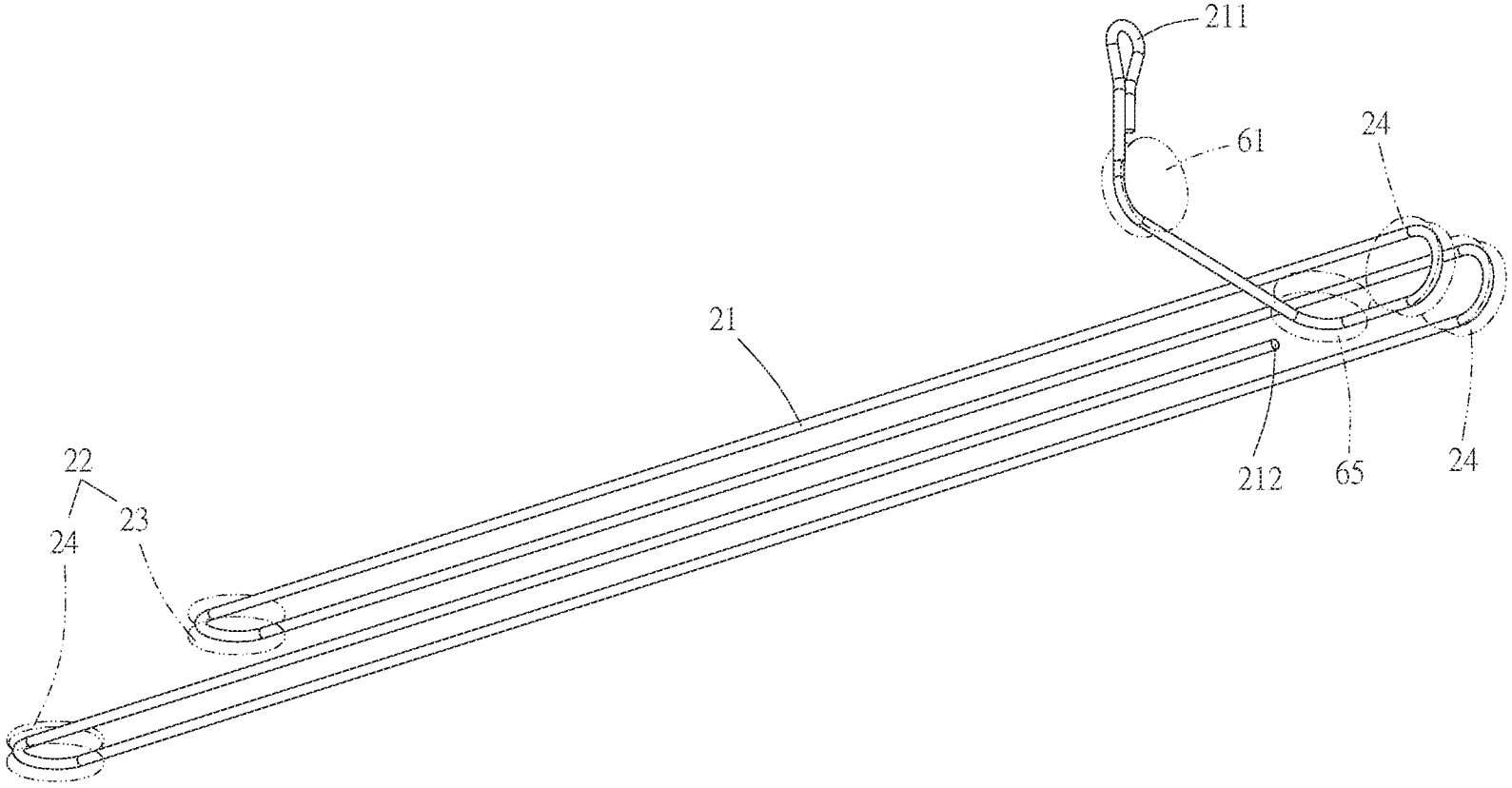
FIG. 4 shows a simple schematic view of configuration of a pull cord and a pulley set, according to the present embodiment.
Figure 5:
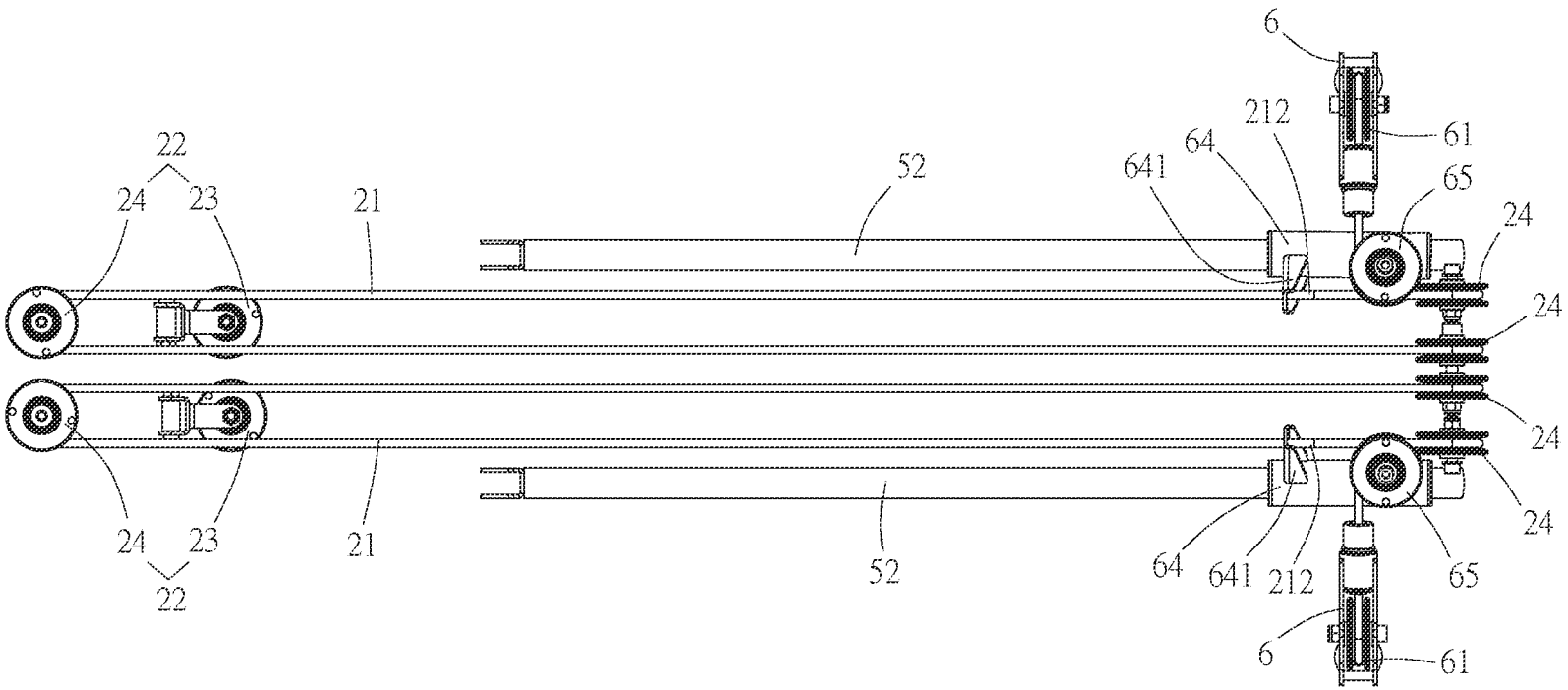
FIG. 5 is a schematic view of structures of the pull cord and pulley set, according to the present embodiment.
Figure 6:
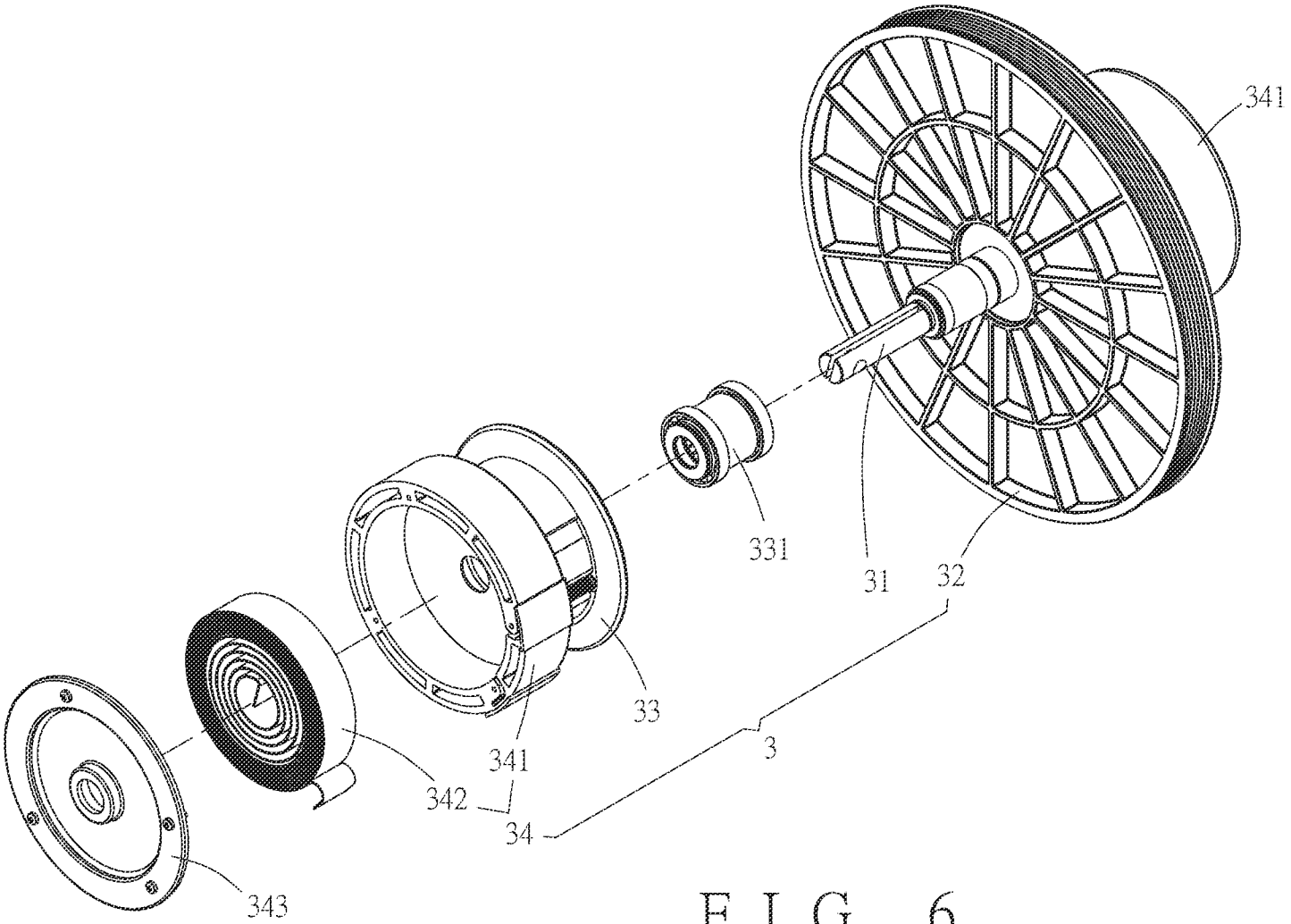
FIG. 6 shows a partially perspective exploded view of a retracting unit, according to the present embodiment.
Figure 7:
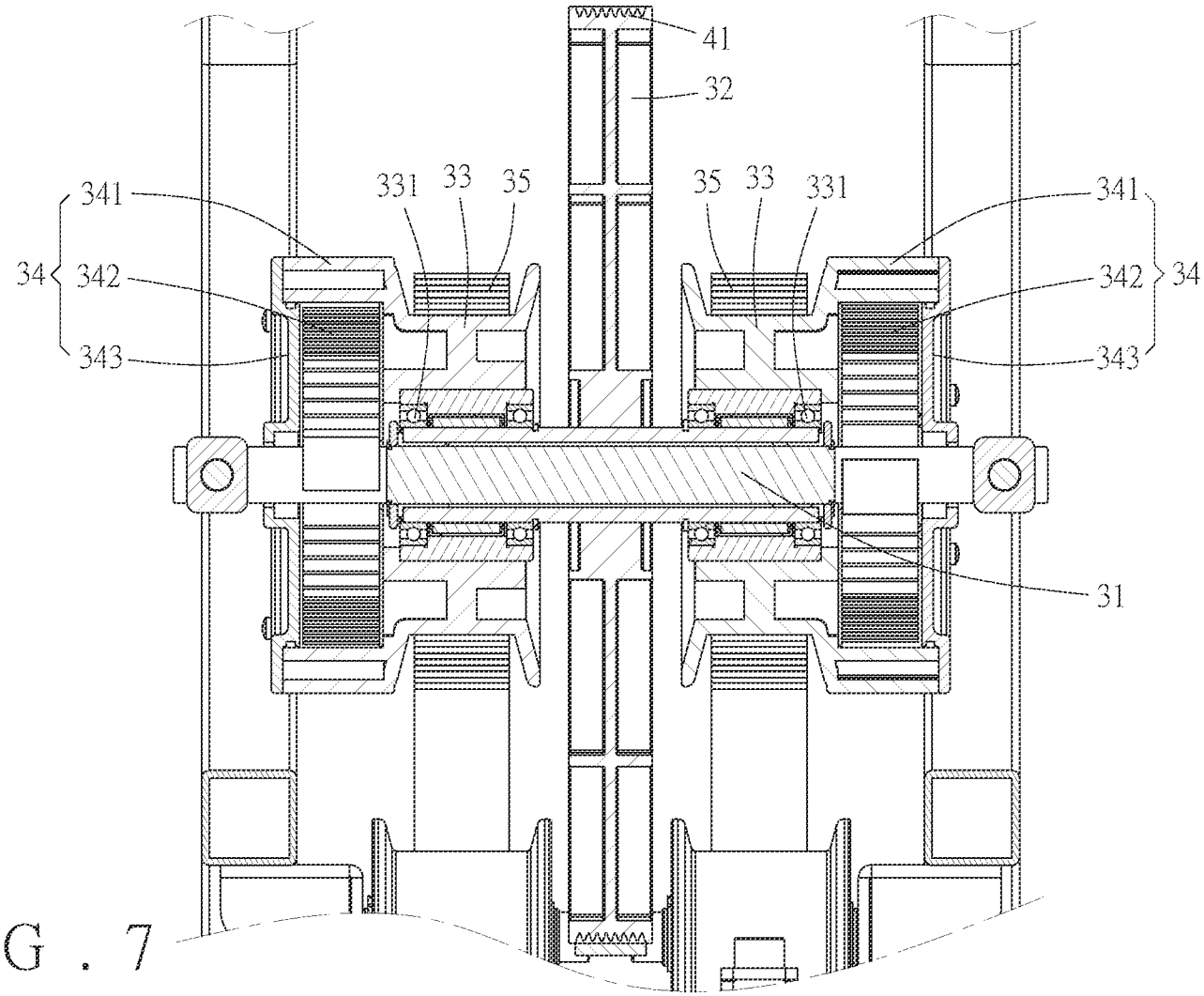
FIG. 7 shows a cutaway view along the line VII-VII in FIG. 2, according to the present embodiment.

The transmission unit 2 is disposed on the base frame 1. As shown in FIG. 2, FIG. 4, and FIG. 5, each transmission unit 2 includes one pull cord 21 and one pulley set 22. The pull cord 21 wraps around the pulley set 22 and moves on a movable path. The pulley set 22 includes a moving pulley 23 and at least one fixed pulley 24. The pull cord 21 includes a free end 211 and a fixed end 212, and the free end 211 passes through the first side roller 141 selectively, allowing the pull cord 21 to move on the first side roller 141; or, the free end 211 passes through the second side roller 142 selectively, allowing the pull cord 21 to move on the second side roller 142. In addition, the free end 211 is selectively fixed on a handle 25. The pull cord 21 wraps around the moving pulley 23 and the fixed pulleys 24. The fixed pulleys 24 are fixed respectively on the first side 12 and the second side 13 of the base frame 1. The moving pulley 23 follows the linking of the pull cord 21 and moves between the first side and the second side 13.

The retracting unit 3 is disposed on the base frame 1. As shown in FIG. 3, FIG. 6, FIG. 7 and FIG. 8, two retracting units 3 are connected to the two transmission units 2, respectively. Each retracting unit 3 includes a spindle 31, a transmission wheel 32, a one-way wheel 33, a retractor 34, a connecting piece 35 and an auxiliary pulley 36. The spindle 31 is pivoted on the base frame 1, and the transmission wheel 32 is fixed on the spindle 31. A one-way bearing 331 is disposed between the one-way wheel 33 and the spindle 31; whereas, by the one-way bearing 331, the one-way wheel 33 drives the spindle in a first rotation direction R1 and rotates idly on the spindle 31 in a second rotation direction R2, with the first rotation direction R1 being opposite to the second rotation direction R2. The retractor 34 is connected to the spindle 31, and includes a casing 341 and a volute spring 342. An end of the volute spring is fixed on an inner wall of the casing 341, and the other end of the volute spring 342 is fixed on the spindle 31. And then, the casing 341 is closed by a sealing cap 343. One end of the connecting piece 35 wraps around the one-way wheel 33 and is fixed; whereas, the other end of the connecting piece wraps around the auxiliary pulley 36 and is connected fixedly to the moving pulley 23. The auxiliary pulley 36 is fixed on the second side 13 of the base frame 1. When an operational force is applied to allow the spindle 31 to rotate in the first rotation direction R1, by providing the one-way bearing 331 between the one-way wheel 33 and the spindle 31, the one-way wheel 33 can be driven to rotate in the first rotation direction R1, through the one-way bearing 331. In a mean time, the retractor 34 will accumulate a restoring force which is opposite to the operational force. When the operational force decreases or disappears, through the one-way bearing 331, the restoring force is used to drive the one-way wheel 33 to rotate idly on the spindle 31 in the second rotation direction R2, thereby retracting the connecting piece 35. In the present embodiment, the base frame 1 is provided with two retracting units 3, and the two retracting units 3 commonly use one spindle 31 and one transmission wheel 32.

Figure 8:
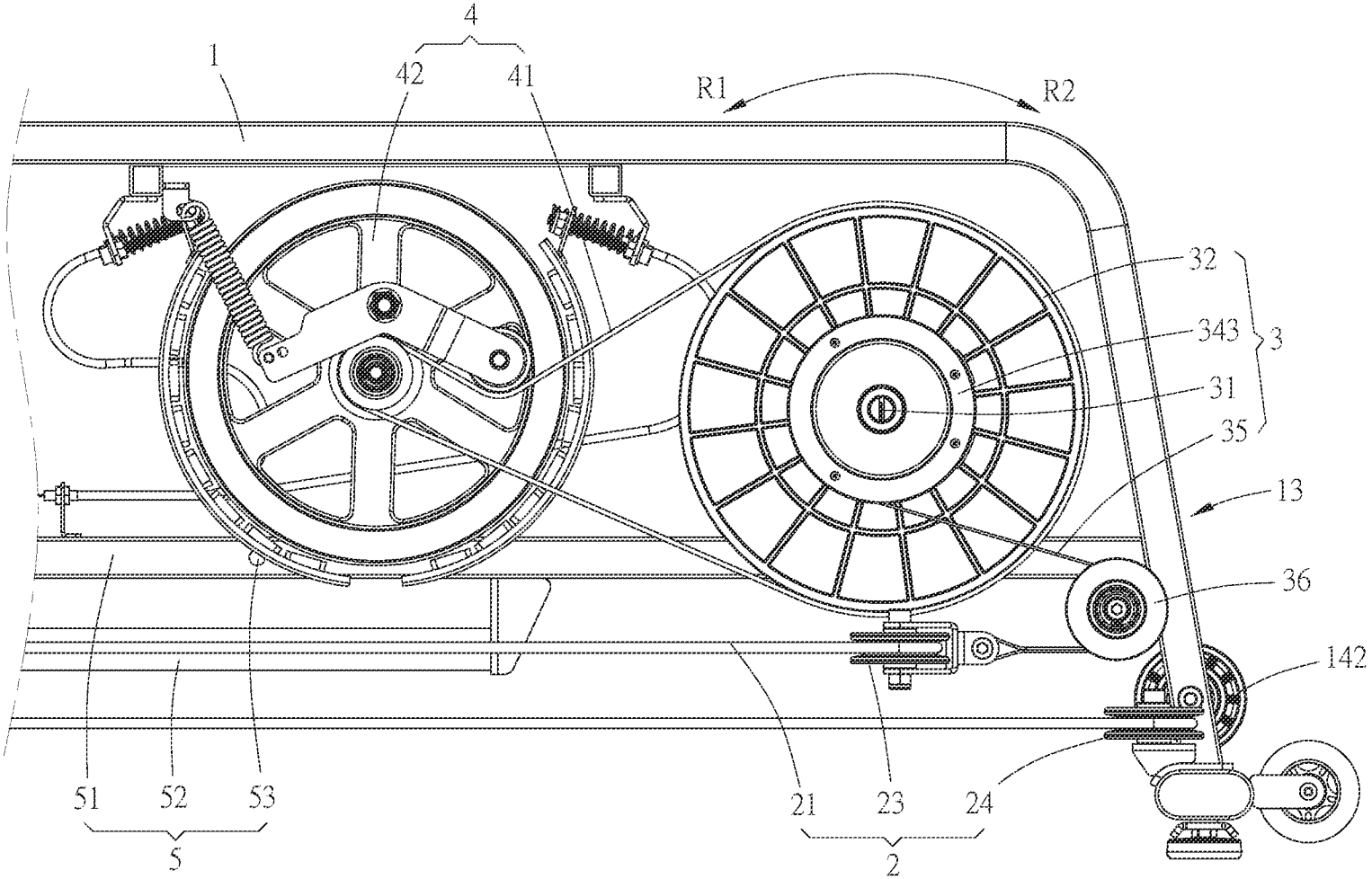
FIG. 8 shows a structural view of an adjustable resistance unit, according to the present embodiment.

The adjustable resistance unit 4 is disposed in the bottom space 10 of the base frame 1. As shown in FIG. 1, FIG. 2 and FIG. 8, the adjustable resistance unit 4 is connected to the spindle 31, allowing the spindle 31 to be equipped with a rotation resistance. The adjustable resistance unit 4 includes a resistance connecting piece 41 and a resistor 42. The resistor 42 is fixed on the base frame 1, whereas the resistance connecting piece 41 is connected to the transmission wheel 32 and the resistor 42. The resistor 42 is used to generate the rotation resistance and is a magnetic resistor, a friction force resistor, an air resistor, a liquid resistor, a motor or an electromagnetic braking resistor. In the present embodiment, the transmission unit 2 is "indirectly" connected to the adjustable resistance unit 4 through the retracting unit 3, and is equipped with the restoring force by the retracting unit 3. However, if the adjustable resistance unit 4 itself is equipped with the resistance and the restoring force, for example the adjustable resistance unit 4 is a motor, then the fixed end 212 of the pull cord 21 in the transmission unit 2 can be fixed "directly" on a spindle of the motor, so that by the rotation of the motor, the transmission unit 2 can be equipped with the resistance and the restoring force. Thus, this type of embodiment will not need to deploy the retracting unit 3.

Figure 9:
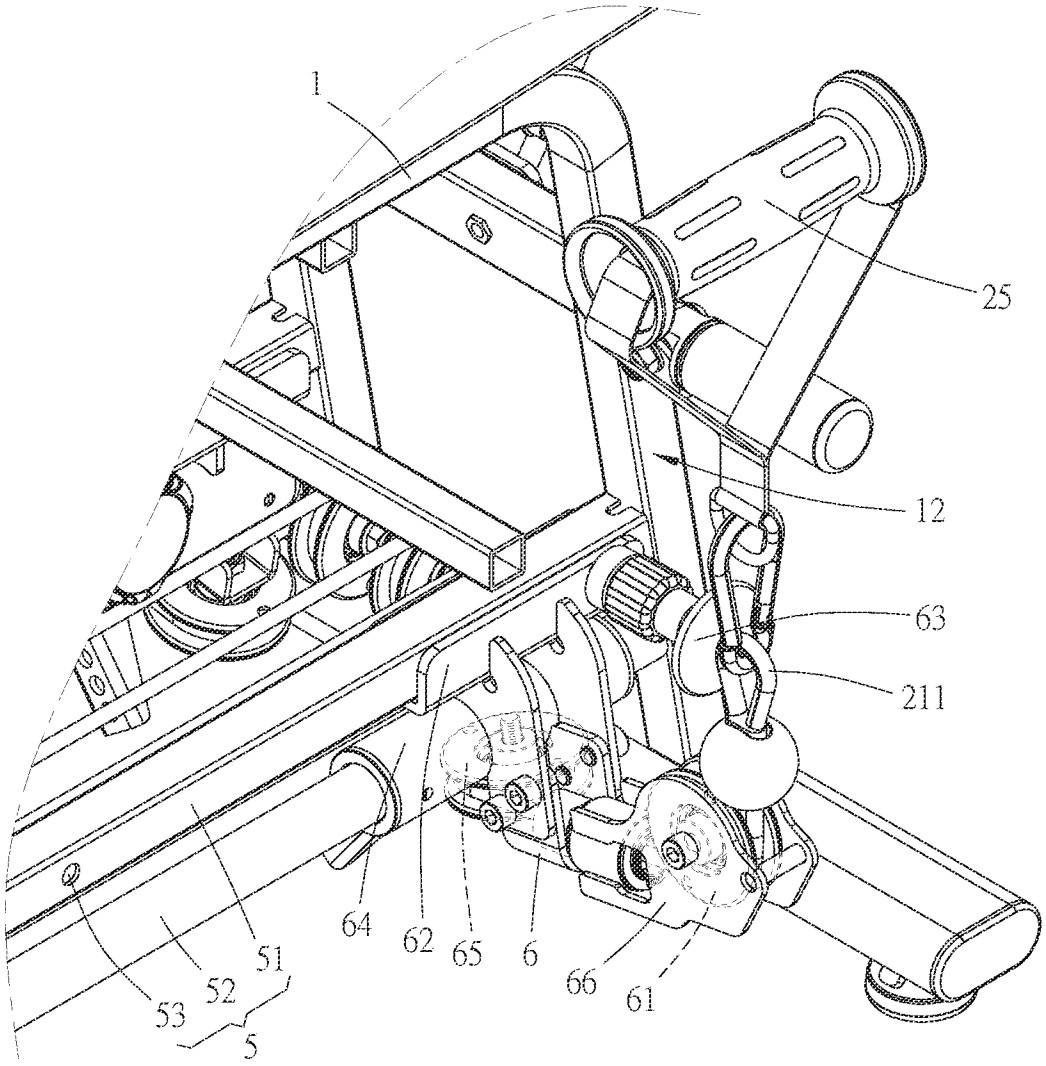
FIG. 9 is a partially structural view of a guiding piece and a movable seat, according to the present embodiment.

The guiding piece 5 is disposed in the bottom space 10 of the base frame 1 and two guiding pieces 5 are all extended in the horizontal direction X. As shown in FIG. 1, FIG. 3 and FIG. 9, each guiding piece 5 includes a positioning rod 51 and a slide rail 52. The positioning rod 51 is provided axially with plural positioning holes 53.

Referring to FIG. 1, FIG. 2, FIG. 3 and FIG. 9, the movable seat 6 selectively moves on or is fixed on the guiding piece 5. Each of the two movable seats 6 includes a slide-assistance portion 61, the pull cord 21 passes through the slide-assistance portion 61, and the free end 211 is exposed out of the slide-assistance portion 61. The movable seat 6 is provided with a positioning seat 62 corresponding to the positioning rod 51, the positioning seat is provided with a positioning member 63, and the positioning member 63 is selectively positioned on the positioning rod 51. The movable seat 6 is provided with a slide seat 64 corresponding to the slide rail 52, and the slide seat 64 is disposed on the slide rail 52. When the positioning member 63 is no longer positioned on the positioning rod 51, the movable seat 6 slides on the guiding piece 5 by the slide seat 64. The positioning member 63 is a positioning pin, and the positioning pin corresponds in configuration to the positioning holes to be inserted into or removed from any one of the positioning holes 53. The slide seat 64 is provided with a securing portion 641 to fix the fixed end 212 of the pull cord 21. The movable seat 6 includes a movable seat roller 65, and the free end 211 of the pull cord 21 wraps around the movable seat roller 65 and then passes through the slide-assistance portion 61. The slide-assistance portion 61 is a perforation or a slide-assistance roller. The slide-assistance roller is pivoted on a slide-assistance roller seat 66, and the slide-assistance roller seat 66 is rotatably fixed on the movable seat 6. By changing a relative position between the movable seat 6 and the guiding piece 5, the position of the slide-assistance portion 61 on the base frame 1 can be changed.

The pull rod 7 can be placed on the accommodation portion 15 of the base frame 1. The pull rod 7 is provided with a pull rod combination portion 71, and the free end 211 is selectively fixed on the pull rod combination portion 71.

The wearing piece 8 is provided with a wearing piece combination portion 81, and the free end 211 is selectively fixed on the wearing piece combination portion 81; whereas the wearing piece 8 is a zip tie.

Figure 10:
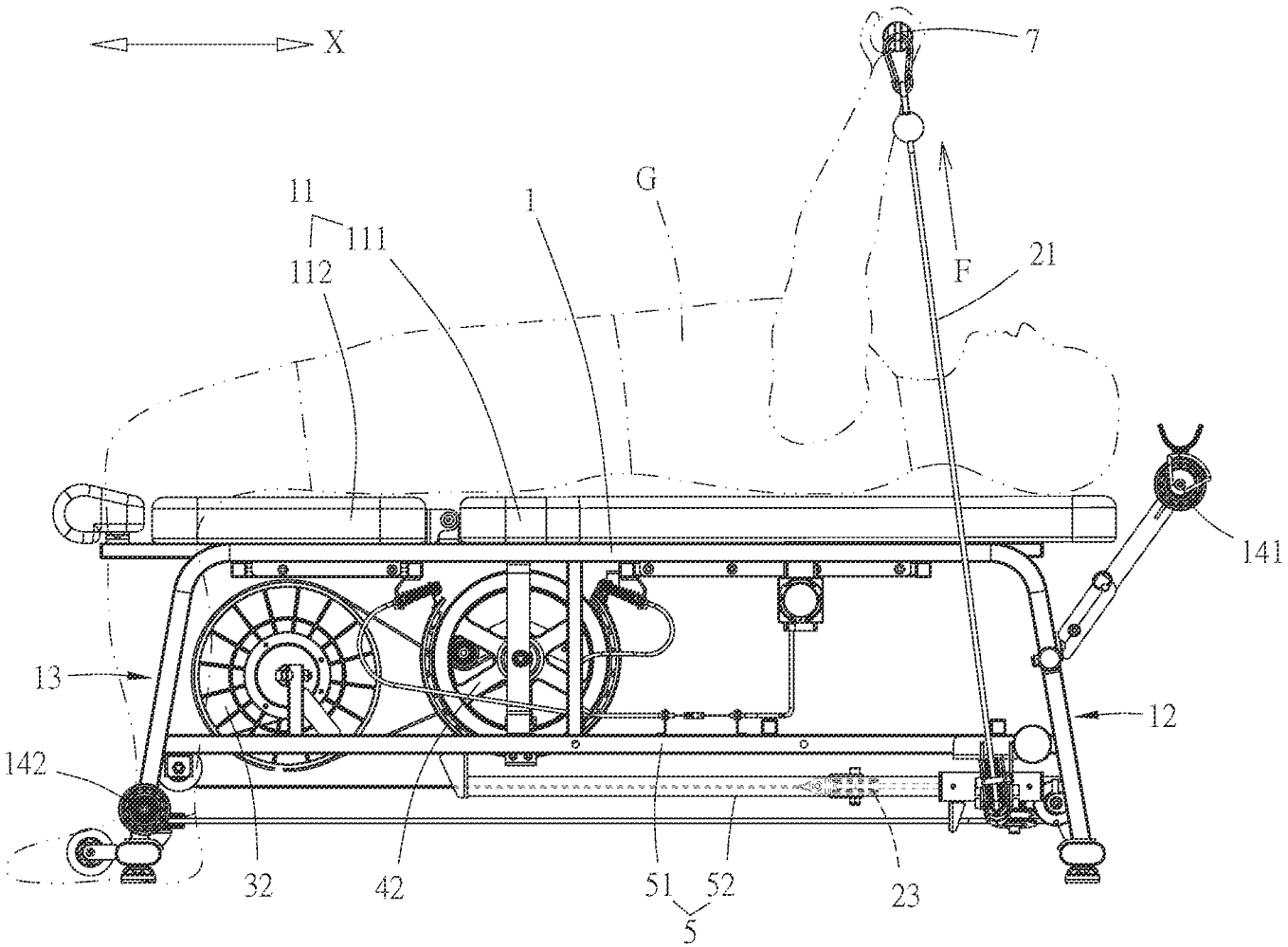
FIG. 10 shows a schematic view of the present embodiment used in a training mode where an operator lies down to lift weight.
Figure 11:
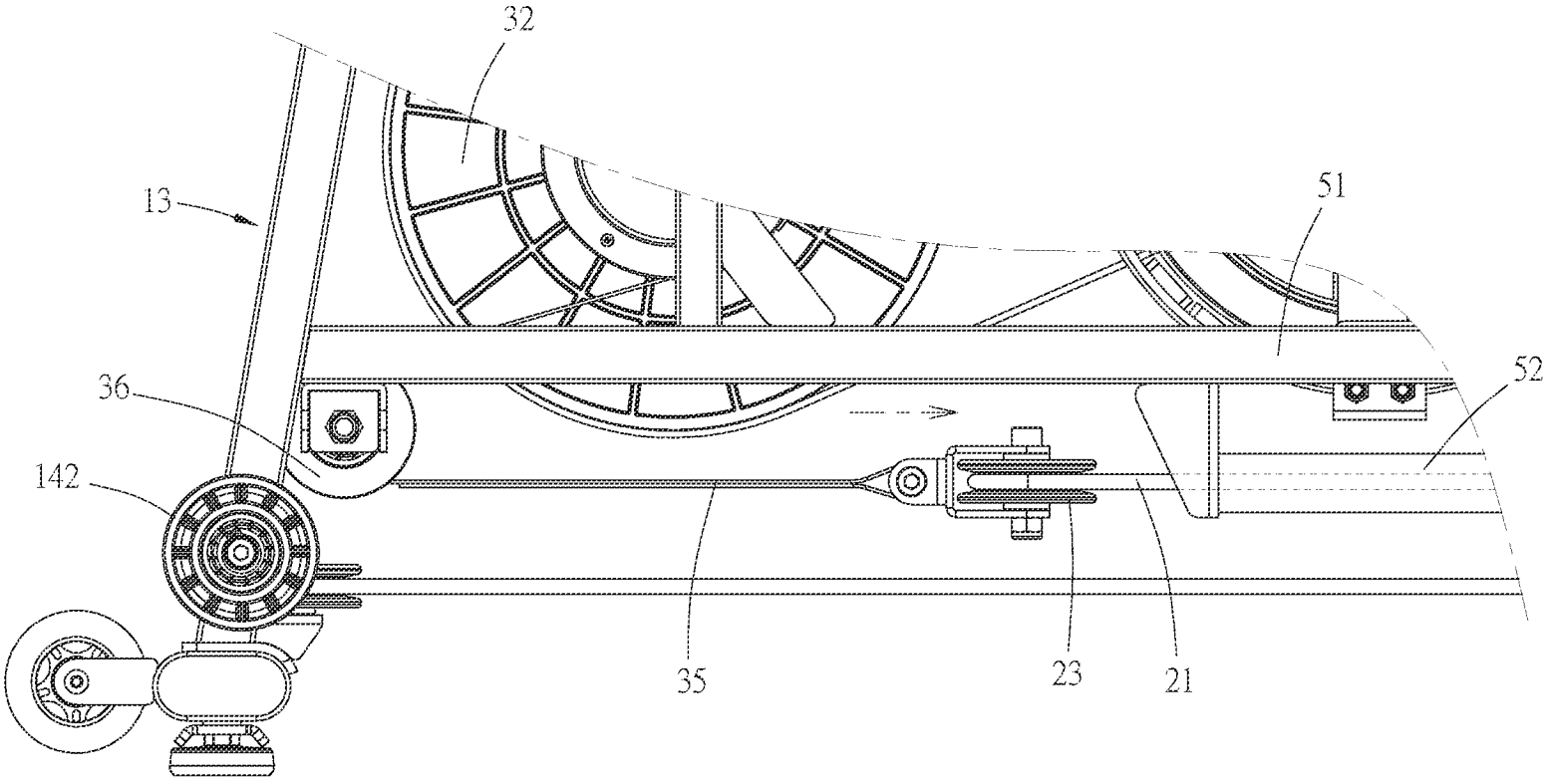
FIG. 11 shows a schematic view of the pull cord linking with a moving pulley to move, according to the present embodiment.

When the present invention is used in a training mode where an operator G lies down to lift weight, as shown in FIG. 1, FIG. 9 and FIG. 10, first the pull rod combination portion 71 of the pull rod 7 is fixed on the free end 211 of the pull cord 21. The operator G lies down flat on the bench portion 11 of the base frame 1, suspends both legs naturally on the second side 13 of the base frame 1, and then uses both hands to hold the pull rod 7 and applies a force to push up the pull rod 7, so as to apply an operational force F to the two pull cords 21 to pull the two pull cords 21.

Referring to FIG. 2, FIG. 7, FIG. 8, FIG. 10 and FIG. 11, next, by that the pull cord 21 links with the moving pulley 23 to move between the fixed pulleys 24, the moving pulley 23 can move to the first side 12 from the second side 13 in the horizontal direction X, and pull the connecting piece 35 at a same time, thereby driving the one-way wheel 33 of the retracting unit 3 to rotate in the first rotation direction R1, so as to drive the spindle 31 to rotate in the first rotation direction R1. When the spindle 31 rotates in the first rotation direction R1, by the one-way bearing 331, the spindle 31 can drive the transmission wheel 32 to rotate in the first rotation direction R1 and rotate the volute spring 342 at a same time, allowing the volute spring 342 to accumulate a restoring force. Through the resistance connecting piece 41, the transmission wheel 32 links with the resistor 42 to rotate, allowing the spindle 31 to be equipped with a rotation resistance. The rotation resistance can be transmitted to the pull rod 7 through the transmission unit 2, in order to train the operator G to lift weight in the lying posture. When the operator G no longer applies the force and puts down the pull rod 7, and the operational force F decreases or disappears, by the one-way bearing 331, the restoring force is used to drive the one-way wheel 33 to rotate idly on the spindle 31 in the second rotation direction R2, thereby retracting the connecting piece 35 to restore to its original location. By applying the force back and forth, it can achieve the function of training hands and chest.

When the present invention is used in a rowing mode for training, as shown in FIG. 1, FIG. 9 and FIG. 12, the free end 211 of the pull cord 21 selectively wraps around the first side roller 141, allowing the pull cord 21 to move on the first side roller 141. The operator G sits on the first pad 111 of the bench portion 11, suspends both legs naturally on the first side 12 of the base frame 1, and then uses both hands to hold the pull rod 7 to apply a force to pull the pull rod 7 in a rear and upward direction, so as to apply an operational force F to the two pull cords 21 to pull the two pull cords 21.

Referring to FIG. 2, FIG. 7, FIG. 8, FIG. 11 and FIG. 12, next, by that the pull cord 21 links with the connecting piece 35, the one-way wheel 33 of the retracting unit 3 is driven to rotate in the first rotation direction R1, and to drive the spindle 31 to rotate in the first rotation direction R1. By the one-way bearing 331, the spindle 31 can drive the transmission wheel 32 to rotate in the first rotation direction R1 and enable the volute spring 342 to accumulate a restoring force at a same time. By the resistance connecting piece 41, the transmission wheel 32 links with the resistor 42 to rotate, allowing the spindle 31 to be equipped with a rotation resistance. The rotation resistance is transmitted to the pull rod 7, in order to train the operator G for the rowing exercise. When the operator G no longer applies a force and puts down the pull rod 7, and the operational force F decreases or disappears, by the one-way bearing 331, the restoring force is used to drive the one-way wheel 33 to rotate idly on the spindle 31 in the second rotation direction R2, thereby retracting the connecting piece 35 to restore to its original location. By applying the force back and forth, it can achieve the function of training hands, chest, back, and legs.

When the present invention is used as dumbbells for training, as shown in FIG. 1, FIG. 9, FIG. 13 and FIG. 14, first a position of the movable seat 6 relative to the guiding piece 5 needs to be adjusted. The positioning member is first taken out to escape from the positioning rod 51, allowing the slide seat of the movable seat 6 to movably slide on the slide rail 52. The positioning seat 62 is made to move from the first side 12 to the second side 13 relative to the positioning rod 51. When the positioning seat 62 moves to a middle section of the positioning rod 51, the positioning member 63 is then positioned in the positioning hole 53 on the positioning rod 51, thereby re-fixing the movable seat on the guiding piece 5. Next, the free end 211 of the pull cord 21 is selectively changed to fix the handle 25. The operator G sits on the bench portion 11, suspends both legs naturally between the first side 12 and the second side 13 of the base frame 1, and uses one hand to hold the handle 25 to apply a force to pull up the handle 25, thereby applying an operational force F to the two pull cords 21 to pull the two pull cords 21.

Referring to FIG. 2, FIG. 7, FIG. 8, FIG. 11 and FIG. 13, next, by that the pull cord 21 links with the connecting piece 35, the one-way wheel 33 of the retracting unit 3 is driven to rotate in the first rotation direction R1, in order to drive the spindle 31 to rotate in the first rotation direction R1. By the one-way bearing 331, the spindle 31 can drive the transmission wheel 32 to rotate in the first rotation direction R1 and allow the volute spring 342 to accumulate a restoring force at a same time. By the resistance connecting piece 41, the transmission wheel 32 links with the resistor 42 to rotate, allowing the spindle to be equipped with a rotation resistance. The rotation resistance is transmitted to the handle 25, in order to train the operator G with a dumbbell exercise. When the operator G no longer applies the force and puts down the handle 25, and the operational force F decreases or disappears, by the one-way bearing 331, the restoring force is used to drive the one-way wheel 33 to rotate idly on the spindle 31 in the second rotation direction R2, thereby retracting the connecting piece 35 to restore to its original location. By applying the force back and forth, it can achieve the function of training arms and chest.

Figure 15:
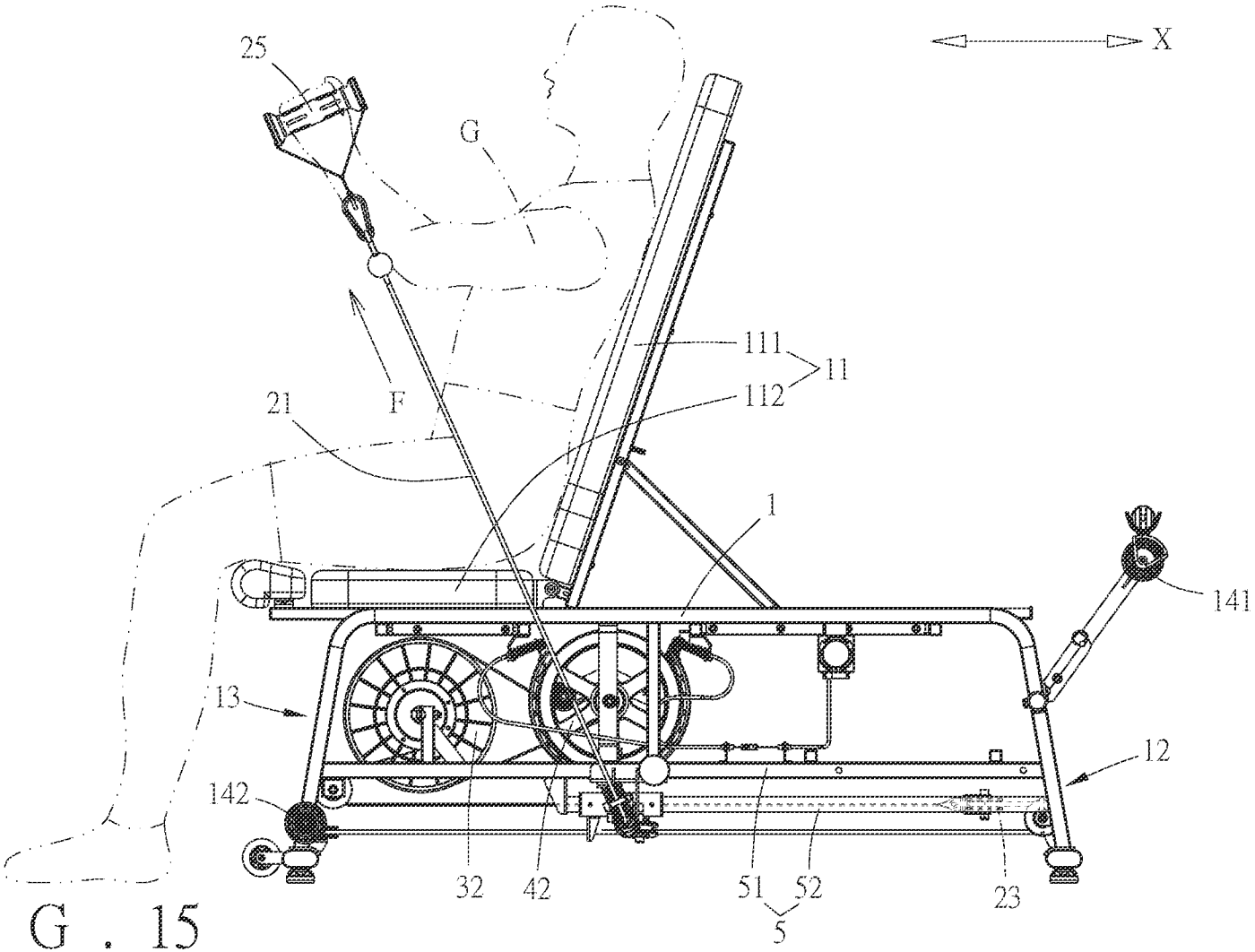
FIG. 15 shows a schematic view of the present embodiment used in a training mode where an operator sits and pulls in an oblique direction.

When the present invention is used in a training mode where the operator G sits and pulls in an oblique direction, as shown in FIG. 1, FIG. 9 and FIG. 15, first, the position of the movable seat 6 relative to the guiding piece 5 needs to be adjusted. The positioning member 63 is first taken out to escape from the positioning rod 51, and the positioning seat 62 is made to move toward the second side 13 from the first side 12 relative to the positioning rod 51. When the positioning seat 62 moves to a section of the positioning rod 51 close to the second side 13, the positioning member 63 is then positioned in the positioning hole 53 on the positioning rod 51, thereby allowing the movable seat 6 to be fixed on the guiding piece 5 again. The operator G sits on the second pad 112 of the bench portion 11, suspends both legs naturally on the second side 13 of the base frame 1, and then uses both hands to hold the handle 25 to apply force, pulling up the handle 25 in an oblique direction, in order to apply the operational force F to the two pull cords 21 to pull the two pull cords 21.

Referring to FIG. 2, FIG. 7, FIG. 8, FIG. 11 and FIG. 15, next, by that the pull cord 21 links with the connecting piece 35, the one-way wheel 33 of the retracting unit 3 is driven to rotate in the first rotation direction R1, in order to drive the spindle 31 to rotate in the first rotation direction R1. By the one-way bearing 331, the spindle 31 can drive the transmission wheel 32 to rotate in the first rotation direction R1 and enable the volute spring 342 to accumulate a restoring force at a same time. By the resistance connecting piece 41, the transmission wheel 32 links with the resistor 42 to rotate, allowing the spindle to be equipped with a rotation resistance. The rotation resistance is transmitted to the handle 25, thereby training the operator G who sits and pulls in an oblique direction. When the operator G no longer applies the force and puts down the handle 25, and the operational force F decreases or disappears, by the one-way bearing 331, the restoring force is used to drive the one-way wheel 33 to rotate idly on the spindle 31 in the second rotation direction R2, thereby retracting the connecting piece 35 to restore to its original location. By applying the force back and forth, it can achieve the function of training arms and chest.

Figure 16:
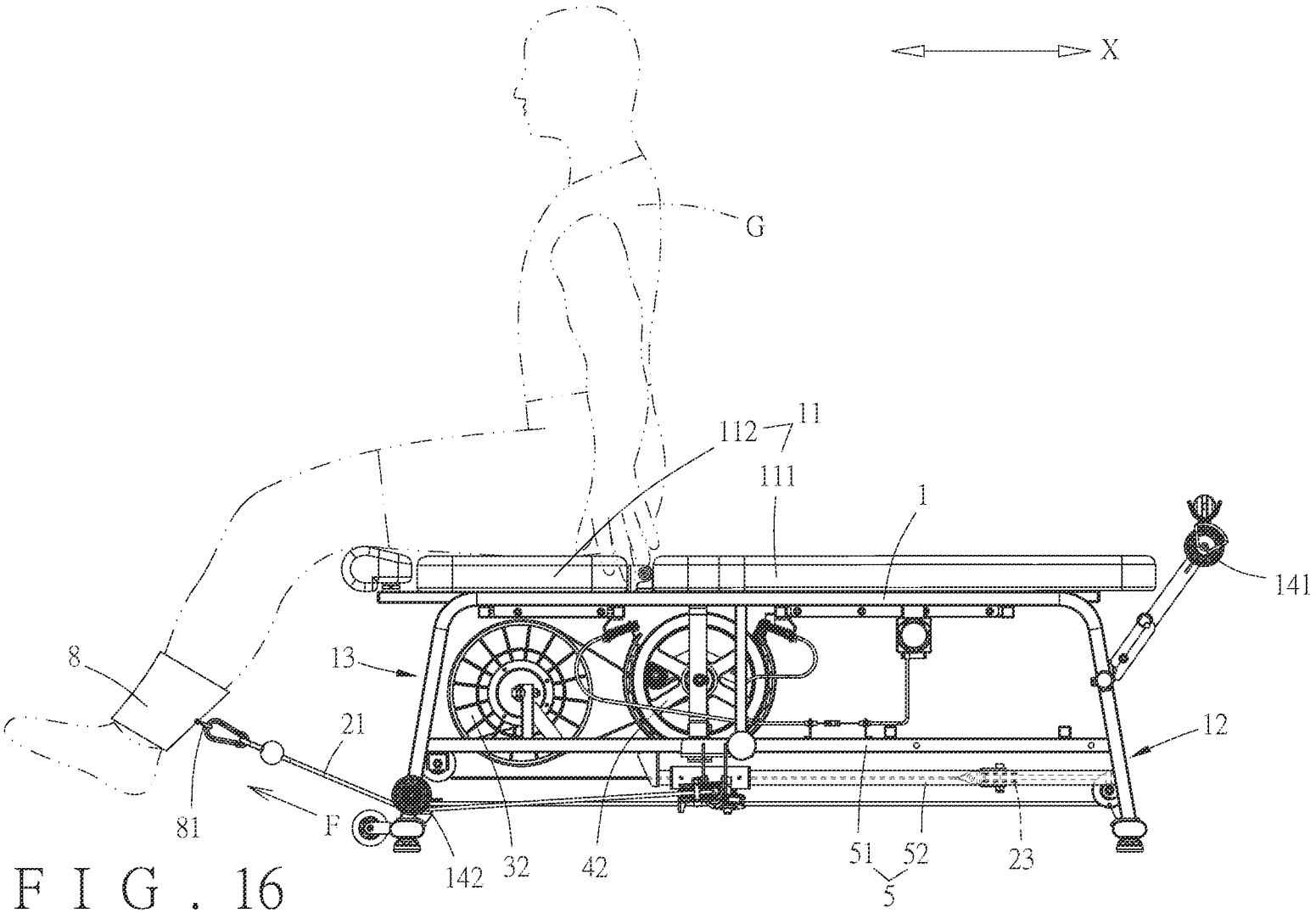
FIG. 16 shows a schematic view of the present embodiment used in a training mode for lifting legs.

When the present invention is used in a training mode for lifting legs, as shown in FIG. 1, FIG. 9 and FIG. 16, the free end 211 of the pull cord 21 wraps around the second side roller 142 selectively, allowing the pull cord 21 to move on the second side roller 142. Next, the wearing piece combination portion 81 of the wearing piece 8 is fixed on the free end 211 of the pull cord 21. The operator G sits on the second pad 112 of the bench portion 11, suspends both legs naturally on the second side 13 of the base frame 1, fastens the wearing pieces 8 on the legs, lifts the legs and applies force, in order to apply the operational force F to the wearing pieces 8 to pull the two pull cords 21.

Referring to FIG. 2, FIG. 7, FIG. 8, FIG. 11 and FIG. 16, next, by that the pull cord 21 links with the connecting piece 35, the one-way wheel 33 of the retracting unit 3 is driven to rotate in the first rotation direction R1, in order to drive the spindle 31 to rotate in the first rotation direction R1. By the one-way bearing 331, the spindle 31 can drive the transmission wheel 32 to rotate in the first rotation direction R1 and enable the volute spring 342 to accumulate a restoring force at a same time. By the resistance connecting piece 41, the transmission wheel 32 links with the resistor 42 to rotate, allowing the spindle to be equipped with a rotation resistance. The rotation resistance is transmitted to the wearing pieces 8, thereby training the operator G for lifting legs. When the operator G no longer applies force and removes the wearing pieces 8, and the operational force F decrease or disappears, by the one-way bearing 331, the restoring force is used to drive the one-way wheel 33 to rotate idly on the spindle 31 in the second rotation direction R2, thereby retracting the connecting piece 35 to restore to its original location. By applying the force back and forth, it can achieve the function of training legs and feet.

In the present invention, the bench seat is combined with the adjustable resistance unit 4. When all kinds of training are executed using the bench seat, the operator G can carry out training by applying force to the first side 12 or the second side 13, and can also perform all kinds of training in a lying down posture, recumbent posture or sit-up posture. When the operator G trains different parts of body using different postures, the required resistance is not necessarily the same; therefore, by the present invention, the features of resistance can be adjusted freely, and the strengths of all kinds of training can be changed as needed.

Figure 17:
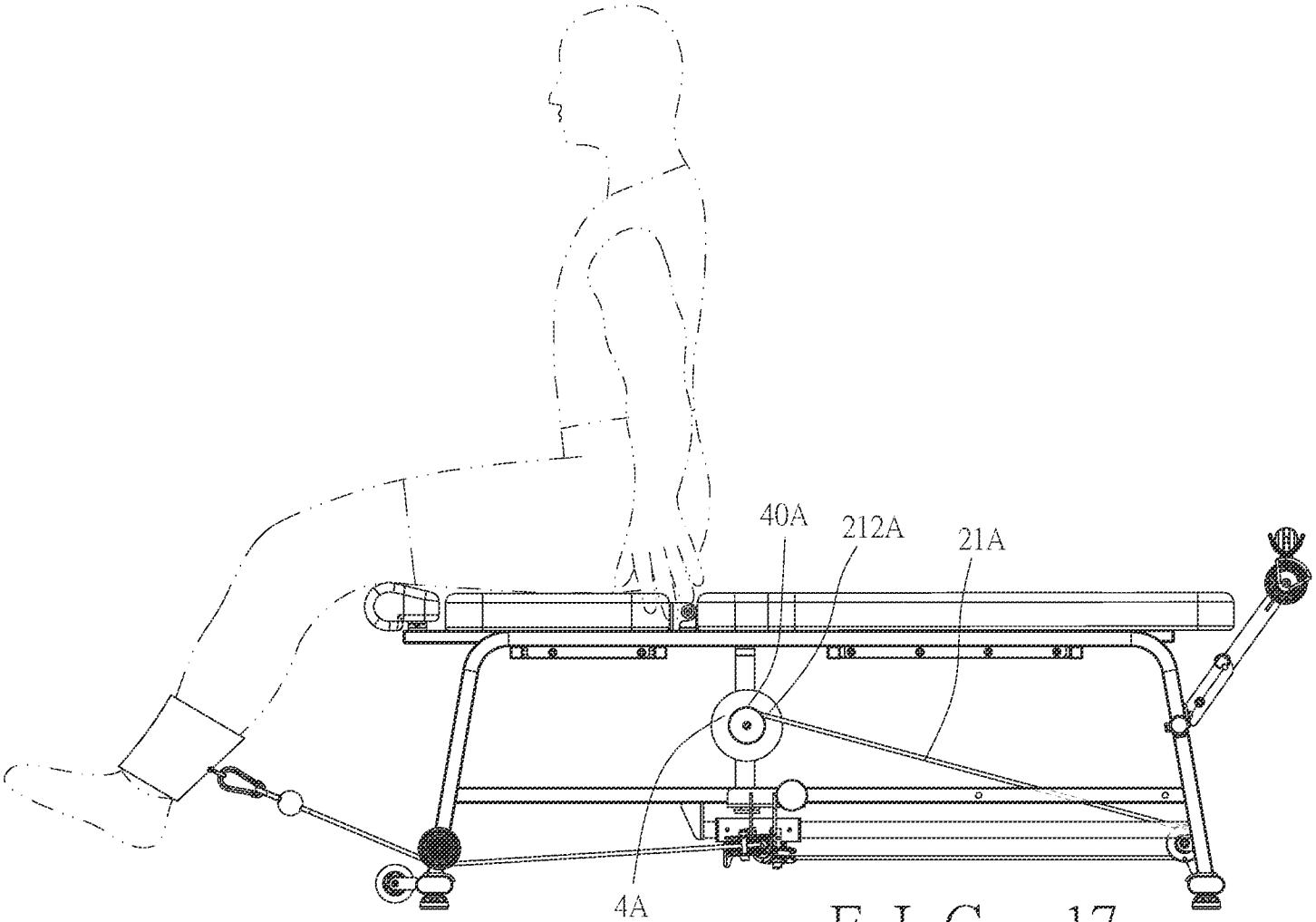
FIG. 17 shows a schematic of the present embodiment using a motor as the adjustable resistance unit.

Referring to FIG. 17, in a different embodiment, the adjustable resistance unit 4A is a motor, and an output shaft of the motor is fixed with a turning wheel 40A. The fixed end 212A of the pull cord 21A is fixed on the turning wheel 40A, and the pull cord 21A is retracted or released following clockwise rotation or counterclockwise rotation of the turning wheel 40A.

Figure 18:
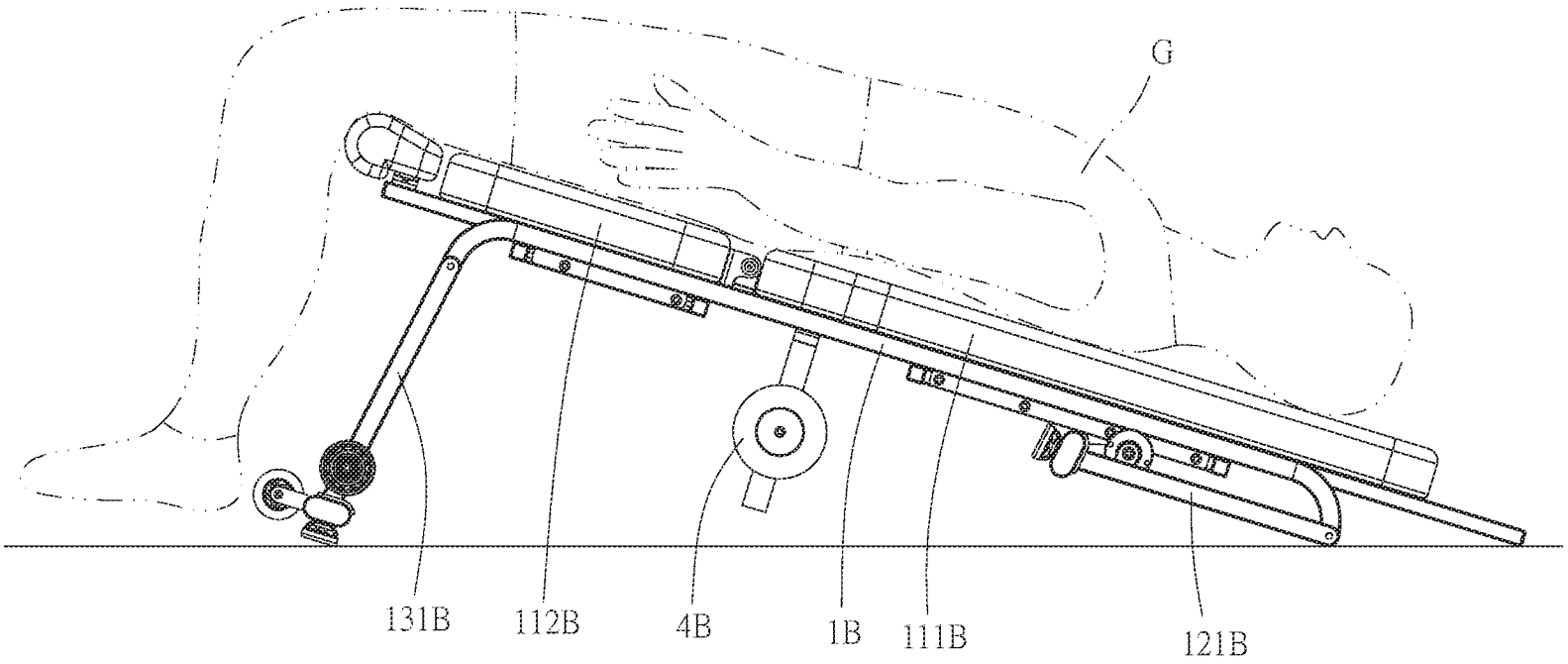
FIG. 18 shows a schematic view of the present embodiment, where a first support portion is bent to put a base frame on ground in an oblique direction.

Referring to FIG. 18, in a different embodiment, the first support portion B is bent on the base frame 1B, whereas the second support portion 131B is not bent. Therefore, the base frame 1B will be placed on ground in an oblique direction, and the included angle between the first pad 111B and the second pad 112B will remain at 0°. Thus, the operator G can lie down on the first pad 111B and the second pad 112B in an oblique direction to carry out all kinds of training, including using the resistance from the adjustable resistance unit 4B to execute training.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A bench seat training structure with adjustable resistance, comprising:

a base frame, which is extended in a horizontal direction and is provided with a first support portion and a second support portion on each end in the horizontal direction, with the base frame being provided with a bench portion in the horizontal direction, the length of the bench portion being extended in the horizontal direction, and the first support portion, the second support portion, and the bench portion jointly defining a bottom space;

at least one transmission unit, which is disposed on the base frame and includes a pull cord, with the pull cord being provided with a free end and a fixed end;

an adjustable resistance unit, which is disposed in the bottom space of the base frame with adjustable resistance; and at least one retracting unit, wherein the number of the retracting unit corresponds to the number of the transmission unit, the at least one retracting unit is disposed on the base frame and is connected to the at least one transmission unit respectively and also connected to the adjustable resistance unit, and the at least one retracting unit provides a restoring force to the corresponding transmission unit, with the restoring force being opposite to the operational force, wherein, the fixed end is directly or indirectly connected to the adjustable resistance unit, an operational force is applied to the free end, the resistance is applied to the fixed end, and the operational force drags the pull cord to move on a moving path, and wherein the at least one transmission unit includes a pulley set, the pulley set includes a moving pulley and a fixed pulley, and the pull cord wraps around the moving pulley and the fixed pulley, with that the at least one retracting unit includes a spindle, a transmission wheel, a one-way wheel, a retractor, a connecting piece, and an auxiliary pulley; and with that the spindle is pivoted on the base frame, the transmission wheel is fixed on the spindle, a one-way bearing is disposed between the one-way wheel and the spindle, the retractor is connected to the spindle, the retractor includes a casing and a volute spring, an end of the volute spring is fixed on an inner wall of the casing, the other end of the volute spring is fixed on the spindle, and the connecting piece is connected to the one-way wheel and the moving pulley.

2. The bench seat training structure with adjustable resistance, according to claim 1, wherein the bench portion includes a first pad and a second pad, the first pad is provided with a first surface, the second pad is provided with a second surface, a changeable included angle is disposed between the first surface and the second surface, and the included angle is between 0° and 180°.

3. The bench seat training structure with adjustable resistance, according to claim 1, wherein the base frame is provided with a first side and an opposite second side in the horizontal direction, the first side is provided with a bracket, the bracket is provided with a first side roller, and the free end selectively passes through the first side roller and is fixed on a handle, allowing the pull cord to move on the first side roller.

4. The bench seat training structure with adjustable resistance, according to claim 1, wherein the base frame is provided with a first side and an opposite second side in the horizontal direction, the second side is provided with a second side roller, and the free end selectively passes through the second side roller and is fixed on a handle, allowing the pull cord to move on the second side roller.

5. The bench seat training structure with adjustable resistance, according to claim 1, further comprising a pull rod, wherein the pull rod is provided with a pull rod combination portion, and the free end is selectively fixed on the pull rod combination portion.

6. The bench seat training structure with adjustable resistance, according to claim 1, further comprising a wearing piece, wherein the wearing piece is provided with a wearing piece combination portion, and the free end is selectively fixed on the wearing piece combination portion.

7. The bench seat training structure with adjustable resistance, according to claim 1, wherein the adjustable resistance unit is a magnetic resistor, a friction force resistor, an air resistor, a liquid resistor, a motor or an electromagnetic braking resistor.

8. The bench seat training structure with adjustable resistance, according to claim 1, wherein the first support portion or the second support portion is bent on the base frame relatively.

9. A bench seat training structure with adjustable resistance, comprising:

a base frame, which is extended in a horizontal direction and is provided with a first support portion and a second support portion on each end in the horizontal direction, with the base frame being provided with a bench portion in the horizontal direction, the length of the bench portion being extended in the horizontal direction, and the first support portion, the second support portion, and the bench portion jointly defining a bottom space;

at least one transmission unit, which is disposed on the base frame and includes a pull cord, with the pull cord being provided with a free end and a fixed end;

an adjustable resistance unit, which is disposed in the bottom space of the base frame with adjustable resistance; and at least one guiding piece and at least one movable seat, wherein the at least one movable seat is provided corresponding to the at least one guiding piece, the at least one guiding piece is disposed in the bottom space, the movable seat moves relatively on or is fixed on the guiding piece selectively, the fixed end is fixed on the corresponding movable seat, the at least one movable seat includes a slide-assistance portion, the pull cord passes through the slide-assistance portion, and the free end is exposed out of the slide-assistance portion; whereas, by changing a relative position between the at least one movable seat and the at least one guiding piece, the position of the slide-assistance portion on the base frame is changed, wherein, the fixed end is directly or indirectly connected to the adjustable resistance unit, an operational force is applied to the free end, the resistance is applied to the fixed end, and the operational force drags the pull cord to move on a moving path.

10. The bench seat training structure with adjustable resistance, according to claim 9, wherein the at least one movable seat includes a movable seat roller, and the pull cord wraps around the movable seat roller and then passes through the slide-assistance portion.

11. The bench seat training structure with adjustable resistance, according to claim 10, wherein the slide-assistance portion is a perforation or a slide-assistance roller.

12. The bench seat training structure with adjustable resistance, according to claim 11, wherein the slide-assistance roller is pivoted on a slide-assistance roller seat, and the slide-assistance roller seat is rotatably fixed on the movable seat.

13. The bench seat training structure with adjustable resistance, according to claim 9, wherein the at least one guiding piece is extended in the horizontal direction, the at least one guiding piece includes a positioning rod and a slide rail, the at least one movable seat is provided with a positioning seat corresponding to the positioning rod, the positioning seat is provided with a positioning member, the positioning member is selectively positioned on the positioning rod, the at least one movable seat is provided with a slide seat corresponding to the slide rail, and the slide seat is disposed on the slide rail; whereas, when the positioning member is no longer positioned on the positioning rod, the movable seat slides on the guiding piece by the slide seat.

14. The bench seat training structure with adjustable resistance, according to claim 13, wherein the positioning rod is provided with plural positioning holes in an axial direction, the positioning member is a positioning pin, and the positioning pin corresponds in configuration to the positioning holes to be inserted into or removed from any one of the positioning holes.

15. The bench seat training structure with adjustable resistance, according to claim 9, wherein the bench portion includes a first pad and a second pad, the first pad is provided with a first surface, the second pad is provided with a second surface, a changeable included angle is disposed between the first surface and the second surface, and the included angle is between 0° and 180°.

16. The bench seat training structure with adjustable resistance, according to claim 9, wherein the base frame is provided with a first side and an opposite second side in the horizontal direction, the first side is provided with a bracket, the bracket is provided with a first side roller, and the free end selectively passes through the first side roller and is fixed on a handle, allowing the pull cord to move on the first side roller.

17. The bench seat training structure with adjustable resistance, according to claim 9, wherein the base frame is provided with a first side and an opposite second side in the horizontal direction, the second side is provided with a second side roller, and the free end selectively passes through the second side roller and is fixed on a handle, allowing the pull cord to move on the second side roller.

18. The bench seat training structure with adjustable resistance, according to claim 9, further comprising a pull rod, wherein the pull rod is provided with a pull rod combination portion, and the free end is selectively fixed on the pull rod combination portion.

19. The bench seat training structure with adjustable resistance, according to claim 9, further comprising a wearing piece, wherein the wearing piece is provided with a wearing piece combination portion, and the free end is selectively fixed on the wearing piece combination portion.

20. The bench seat training structure with adjustable resistance, according to claim 9, wherein the adjustable resistance unit is a magnetic resistor, a friction force resistor, an air resistor, a liquid resistor, a motor or an electromagnetic braking resistor.

21. The bench seat training structure with adjustable resistance, according to claim 9, wherein the first support portion or the second support portion is bent on the base frame relatively.

* * * * *